US009434060B1

(12) United States Patent
Grinalds et al.

(10) Patent No.: US 9,434,060 B1
(45) Date of Patent: Sep. 6, 2016

(54) BOTTLE CAP REMOVING CUTLERY

(71) Applicants: Stephen Henry Grinalds, San Diego, CA (US); Kevin Samuel Newburg, San Diego, CA (US)

(72) Inventors: Stephen Henry Grinalds, San Diego, CA (US); Kevin Samuel Newburg, San Diego, CA (US)

( * ) Notice: Subject to any disclaimer, the term of this patent is extended or adjusted under 35 U.S.C. 154(b) by 249 days.

(21) Appl. No.: 14/244,898

(22) Filed: Apr. 4, 2014

Related U.S. Application Data

(60) Provisional application No. 61/809,194, filed on Apr. 5, 2013.

(51) Int. Cl.

| | |
|---|---|
| ***B25F 1/00*** | (2006.01) |
| ***A47G 21/06*** | (2006.01) |
| ***A47G 21/04*** | (2006.01) |
| ***A47G 21/02*** | (2006.01) |
| ***B26B 11/00*** | (2006.01) |

(52) U.S. Cl.
CPC ..... *B25F 1/00* (2013.01); *A47G 21/023* (2013.01); *A47G 21/04* (2013.01); *A47G 21/06* (2013.01); *B26B 11/00* (2013.01)

(58) Field of Classification Search
CPC ..... B25F 1/00; B26B 11/00
USPC ..... 7/112, 113
See application file for complete search history.

(56) References Cited

U.S. PATENT DOCUMENTS

| | | | | |
|---|---|---|---|---|
| 96,134 | A | | 10/1869 | McMorries |
| 1,324,565 | A | | 12/1919 | Przybylek |
| 1,341,153 | A | | 5/1920 | Parker et al. |
| D130,056 | S | | 10/1941 | Burton |
| D138,750 | S | * | 9/1944 | Swenson ..... D8/16 |
| D145,144 | S | | 7/1946 | Price |
| D160,695 | S | | 10/1950 | De Fee |
| D177,740 | S | | 5/1956 | Latham |
| D185,208 | S | | 5/1959 | Jones |
| D185,679 | S | | 7/1959 | Rector |
| D187,589 | S | | 4/1960 | Prip |
| D189,820 | S | | 2/1961 | Barr |
| D189,885 | S | * | 3/1961 | Gerson ..... 30/429 |
| D189,913 | S | | 3/1961 | Quistgaard |
| 3,059,252 | A | * | 10/1962 | Comeau ..... A47J 43/281 30/147 |
| D202,892 | S | | 11/1965 | Centa |
| D209,778 | S | | 1/1968 | Erenhouse |
| 3,376,640 | A | | 4/1968 | Coursen |
| D261,093 | S | | 10/1981 | Segal |
| D270,701 | S | | 9/1983 | Cassini |
| 4,409,864 | A | | 10/1983 | Gaskins |
| 4,610,087 | A | | 9/1986 | Mickelson et al. |
| D305,289 | S | | 1/1990 | Robinson |
| D334,118 | S | | 3/1993 | Gebhardt |
| 5,189,750 | A | | 3/1993 | Brennan |
| D342,422 | S | | 12/1993 | Sanford |
| 5,267,494 | A | | 12/1993 | Waluda |
| D351,091 | S | | 10/1994 | Burdick et al. |
| D354,895 | S | | 1/1995 | Flynn |
| D358,741 | S | | 5/1995 | Burdick et al. |
| 5,829,965 | A | | 11/1998 | Rubalcava |
| D411,417 | S | | 6/1999 | Gebhardt |
| D411,719 | S | | 6/1999 | Shane-Schuldt |

(Continued)

*Primary Examiner* — Hadi Shakeri
(74) *Attorney, Agent, or Firm* — Clause Eight IPS; Michael Catania

(57) ABSTRACT

A bottle cap removing cutlery is disclosed herein. The bottle cap removing cutlery comprises a main body, a cutlery member, a bottle cap opener. The cutlery member is preferably a knife, spoon, fork or like utensil. The bottle cap opener comprises a fulcrum portion, a lifting portion and an opener cutout.

4 Claims, 3 Drawing Sheets

(56) References Cited

U.S. PATENT DOCUMENTS

| | | | | |
|---|---|---|---|---|
| D431,758 | S | | 10/2000 | Junko |
| D434,616 | S | | 12/2000 | Joergensen |
| D470,021 | S | | 2/2003 | Jalet |
| D483,991 | S | | 12/2003 | Poupel |
| D491,026 | S | | 6/2004 | Welch |
| D492,163 | S | | 6/2004 | Welch |
| 6,918,150 | B1 | | 7/2005 | Robinson |
| D516,392 | S | | 3/2006 | de Vries |
| 7,055,200 | B2 | | 6/2006 | Lion et al. |
| D535,857 | S | | 1/2007 | Bristow |
| D547,132 | S | | 7/2007 | Claramunt |
| 7,313,983 | B1 | | 1/2008 | Book |
| D572,091 | S | | 7/2008 | Holcomb |
| D578,357 | S | | 10/2008 | Shane-Schuldt |
| D579,732 | S | | 11/2008 | deBretton Gordon |
| D579,734 | S | | 11/2008 | Holcomb |
| D590,670 | S | | 4/2009 | Coppo |
| D613,129 | S | | 4/2010 | Holcomb |
| 7,698,767 | B2 | | 4/2010 | Clark, Jr. |
| D618,055 | S | | 6/2010 | Richmond |
| D625,556 | S | | 10/2010 | Ito |
| D656,781 | S | | 4/2012 | Holcomb |
| D657,190 | S | | 4/2012 | Shane-Schuldt |
| 8,220,075 | B2 | | 7/2012 | Chen et al. |
| D671,360 | S | | 11/2012 | Shane Schuldt |
| D672,619 | S | * | 12/2012 | deBretton Gordon ..... D7/642 |
| D674,669 | S | | 1/2013 | Gerli |
| D681,401 | S | | 5/2013 | Donovan |
| D684,434 | S | | 6/2013 | Harris et al. |
| D706,078 | S | | 6/2014 | Shane-Schuldt |
| D706,100 | S | | 6/2014 | Olson et al. |
| D712,207 | S | | 9/2014 | Donovan |
| 2013/0133206 | A1 | | 5/2013 | Donovan |
| 2013/0133207 | A1 | | 5/2013 | Donovan |

* cited by examiner

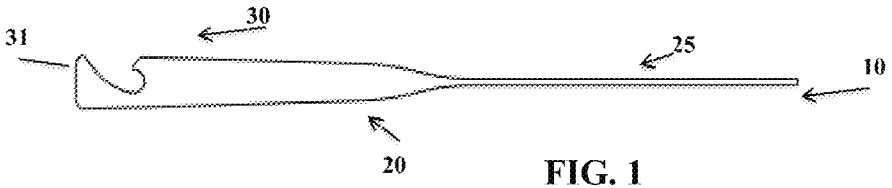
FIG. 1
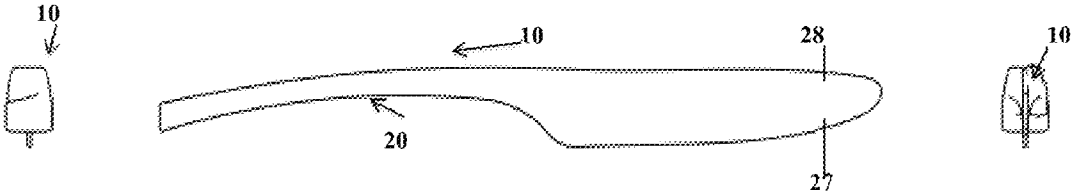
FIG. 3
FIG. 4
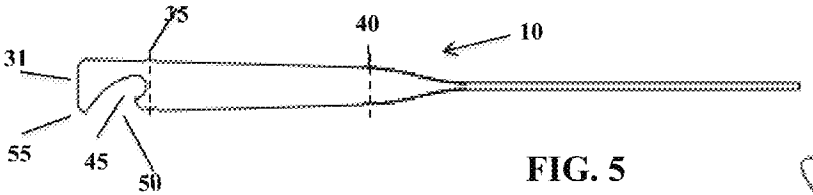
FIG. 2
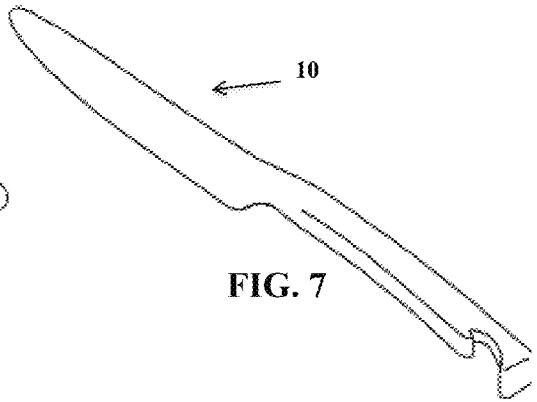
FIG. 5
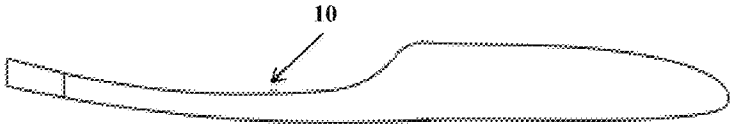
FIG. 6
FIG. 7

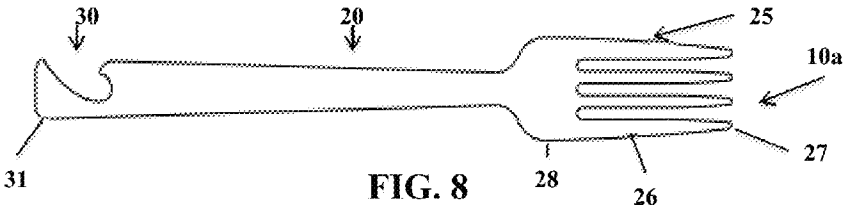
FIG. 8
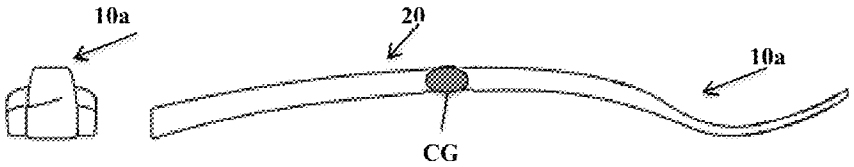
FIG. 9
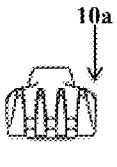
FIG. 10
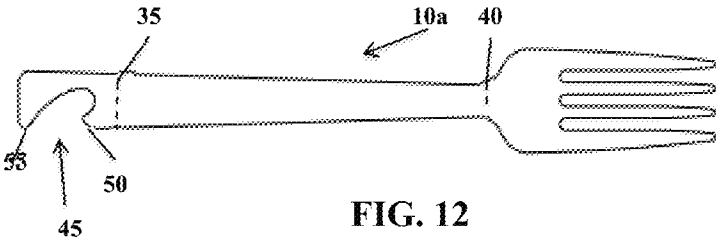
FIG. 11
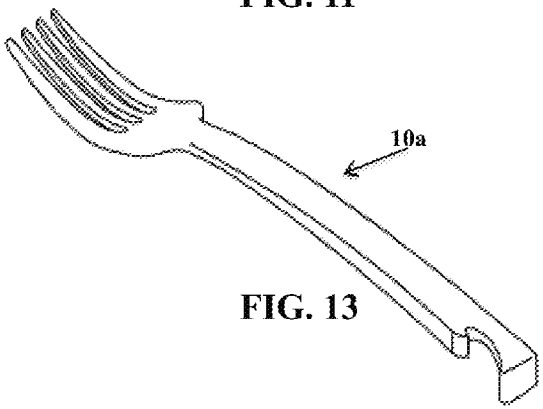
FIG. 12
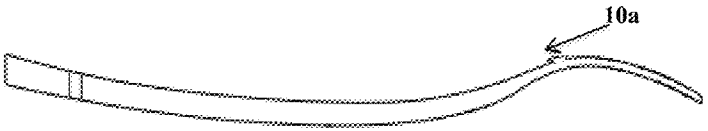
FIG. 13
FIG. 14

BOTTLE CAP REMOVING CUTLERY

CROSS REFERENCE TO RELATED APPLICATION

The Present Application claims priority to U.S. Provisional Patent Application No. 61/8099194, filed on Apr. 5, 2013, which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to cutlery.

2. Description of the Related Art

The situation where a traditional bottle cap remover is not present but cutlery is present leads beverage consumers to use the cutlery to open the bottle. A bottle cap is very difficult to remove with existing cutlery designs. Often, beverage consumers use very destructive methods to remove bottle caps, which results in property damage, to the cutlery, the bottle or both.

McMorries, U.S. Pat. No. 96134 discloses a rotable, circular knife attached to a shaft, with a fork pivotally attached to the same shaft to allow a user to force the knife into the food when it is impaled by the fork to cause it to cut via a repetitive lateral motion.

Przybylek, U.S. Pat. No. 1,324,565 discloses a fork in combination with a knife.

Parker et al., U.S. Pat. No. 1,341,153 discloses a fork in combination with a knife.

Coursen, U.S. Pat. No. 1,585,533 discloses a fork in combination with a knife.

Kramer et al., U.S. Pat. No. 3,376,640 discloses a knife and fork combination wherein the knife is electromechanically operated.

U.S. Pat. No. 7,698,767 for a Combination Bar Tool discloses a first piece includes a stirring spoon, a bottle opener, and a corkscrew, and a second piece that includes a removable cover that attaches to the corkscrew base to cover the corkscrew.

U.S. Pat. No. 5,829,965 for a Multifunction Waiter's Tool discloses a multifunction waiter's tool for combining functions of bottle opener, cigarette lighter, and bread crumb remover. The inventive device includes a handle portion. A bottle opener is pivotally coupled with the handle portion. A utility knife is pivotally coupled with the handle portion. A cork screw is pivotally coupled with the handle portion. A cigarette lighter is disposed within the handle portion opposite the utility knife. A bread crumb removing tool is slidably disposed within the handle portion.

U.S. Pat. No. 7,055,200 for Multi-purpose Ice Tongs discloses ice tongs that include a handle and a pair of tongs that extend from the handle and that collectively are able to pick-up an ice cube or other item typically used in the preparation of drinks One of the tongs includes a grater surface for grating a food item. The multi-purpose ice tongs can also include a bottle opener that extends from the handle, a knife stored within the handle, and a zester component within the knife. The surface of the handle of the ice tongs may be utilized as an ice hammer, and one end of the handle is made of a suitable material to enable it to crush a food item contained within a drink glass without breaking the glass.

As used herein, cutlery refers to an instrument used in preparing, serving and/or eating food. Preferably, cutlery refers to a spoon, knife, fork, or any like utensil. The prior art discusses various instruments that have been combined with a bottle opener. However, the prior art fails to disclose the combination of a bottle opener with cutlery.

BRIEF SUMMARY OF THE INVENTION

The present invention provides a solution to the situation where no traditional bottle cap remover is present. The present invention is bottle cap removing cutlery which functions as traditional cutlery but also functions as a bottle opener, thereby providing users with a mean to open a capped bottle.

One aspect of the present invention is a bottle cap removing cutlery comprising a main body, a cutlery end comprising a cutlery member, and a bottle cap removing end comprising a bottle cap opener. The cutlery end is positioned at an opposite end of the main body from the bottle cap removing end.

Another aspect of the present invention is a bottle cap removing cutlery comprising a main body, a cutlery member, wherein the cutlery member is one of a knife, spoon and fork, and a bottle cap opener comprising a fulcrum portion, a lifting portion and an opener cutout. The main body preferably ranges from 30% to 80% of the length of the bottle cap removing cutlery, the bottle cap opener preferably ranges from 5% to 33% of the length of the bottle cap removing cutlery, and the cutlery member preferably ranges from 5% to 33% of the length of the bottle cap removing cutlery.

Yet another aspect of the present invention is a bottle cap removing cutlery set comprising a plurality of bottle cap removing knifes, a plurality of bottle cap removing spoons and a plurality of bottle cap removing forks. Each of plurality of bottle cap removing knifes comprises a main body, a cutlery end comprising a knife member, and a bottle cap removing end comprising a bottle cap opener. Each of plurality of bottle cap removing spoons comprises a main body, a cutlery end comprising a spoon member, and a bottle cap removing end comprising a bottle cap opener. Each of plurality of bottle cap removing forks comprises a main body, a cutlery end comprising a fork member, and a bottle cap removing end comprising a bottle cap opener. Preferably the set comprises eight bottle cap removing knives, eight bottle cap removing forks, and eight bottle cap removing spoons. However, those skilled in the pertinent art will recognize that any number of pieces may be combined for a bottle cap removing cutlery set.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 1 is a top plan view of a Bottle Cap Removing Knife.

FIG. 2 is a rear plan view of the Bottle Cap Removing Knife of FIG. 1.

FIG. 3 is a side plan view of the Bottle Cap Removing Knife of FIG. 1.

FIG. 4 is a front plan view of the Bottle Cap Removing Knife of FIG. 1.

FIG. 5 is a bottom plan view of the Bottle Cap Removing Knife of FIG. 1.

FIG. 6 is a side plan view of the Bottle Cap Removing Knife of FIG. 1.

FIG. 7 is a top perspective view of a Bottle Cap Removing Knife of FIG. 1.

FIG. 8 is a top plan view of a Bottle Cap Removing Fork.

FIG. 9 is a rear plan view of the Bottle Cap Removing Fork of FIG. 8.

FIG. 10 is a side plan view of the Bottle Cap Removing Fork of FIG. 8.

FIG. 11 is a front plan view of the Bottle Cap Removing Fork of FIG. 8.

FIG. 12 is a bottom plan view of the Bottle Cap Removing Fork of FIG. 8.

FIG. 13 is a side plan view of the Bottle Cap Removing Fork of FIG. 8.

FIG. 14 is a top perspective view of a Bottle Cap Removing Fork of FIG. 8.

DETAILED DESCRIPTION OF THE INVENTION

Figure 15:
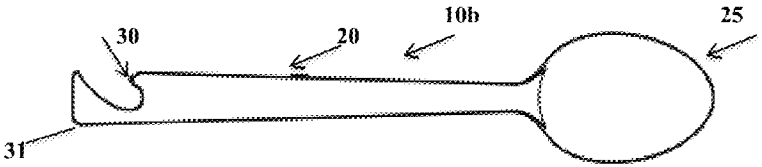
FIG. 15 is a top plan view of a Bottle Cap Removing Spoon.

As shown in FIGS. 1-7, a bottle cap removing knife is generally designated 10. The preferably bottle cap removing knife 10 comprises a main body 20, a cutlery end 25 and a bottle cap removing end 30. The bottle cap removing end 30 preferably comprises a bottle cap opener 31 that preferably comprises an opener cutout 45, a fulcrum portion 50 and a lifting portion 55. The cutlery end 25 preferably comprises a knife member 26 preferably comprising a sharp surface 27 and a top surface 28. A center of gravity CG of the bottle cap removing knife 10 preferably lies in the center of the main body 20.

Dashed lines 35 and 40 illustrate a boundary between the main body 20 and the cutlery end 25 and the bottle cap removing end 30. Preferably the main body 20 ranges from 30% to 80% of the length of the bottle cap removing knife 10, more preferably from 40% to 70% of the length of the bottle cap removing knife 10, and most preferably from 50% to 60% of the length of the bottle cap removing knife 10. Preferably the bottle cap removing end 30 ranges from 5% to 33% of the length of the bottle cap removing knife 10, more preferably from 10% to 25% of the length of the bottle cap removing knife 10, and most preferably from 15% to 20% of the length of the bottle cap removing knife 10. Preferably the cutlery end 25 ranges from 5% to 33% of the length of the bottle cap removing knife 10, more preferably from 10% to 25% of the length of the bottle cap removing knife 10, and most preferably from 15% to 20% of the length of the bottle cap removing knife 10.

Preferably, the bottle cap opener 31 is substantially perpendicular to a plane of the knife member 26.

A user preferably grasps the bottle cap removing knife 10 within the main body 20.

As shown in FIGS. 8-14, a bottle cap removing fork is generally designated 10*a*. The preferably bottle cap removing fork 10*a* comprises a main body 20, a cutlery end 25 and a bottle cap removing end 30. The bottle cap removing end 30 preferably comprises a bottle cap opener 31 that preferably comprises an opener cutout 45, a fulcrum portion 50 and a lifting portion 55. The cutlery end 25 preferably comprises a fork member 26 preferably comprising prongs 27 and a curved portion 28. A center of gravity CG of the bottle cap removing fork 10*a* preferably lies in the center of the main body 20.

Dashed lines 35 and 40 illustrate a boundary between the main body 20 and the cutlery end 25 and the bottle cap opening end 30. Preferably the main body 20 ranges from 30% to 80% of the length of the bottle cap removing fork 10*a*, more preferably from 40% to 70% of the length of the bottle cap removing fork 10*a*, and most preferably from 50% to 60% of the length of the bottle cap removing fork 10*a*. Preferably the bottle cap removing end 30 ranges from 5% to 33% of the length of the bottle cap removing fork 10*a*, more preferably from 10% to 25% of the length of the bottle cap removing fork 10*a*, and most preferably from 15% to 20% of the length of the bottle cap removing fork 10*a*. Preferably the cutlery end 25 ranges from 5% to 33% of the length of the bottle cap removing fork 10*a*, more preferably from 10% to 25% of the length of the bottle cap removing fork 10*a*, and most preferably from 15% to 20% of the length of the bottle cap removing fork 10*a*.

Preferably, the bottle cap opener 31 is substantially parallel to a plane of the fork member 26.

A user preferably grasps the bottle cap removing fork 10*a* within the main body 20.

Figure 17:
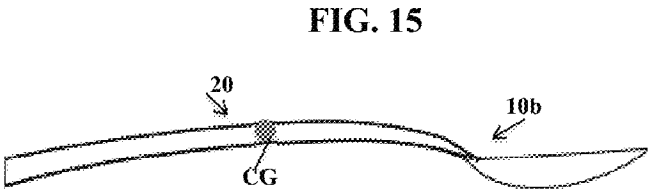
FIG. 17 is a side plan view of the Bottle Cap Removing Spoon of FIG. 15.
Figure 18:
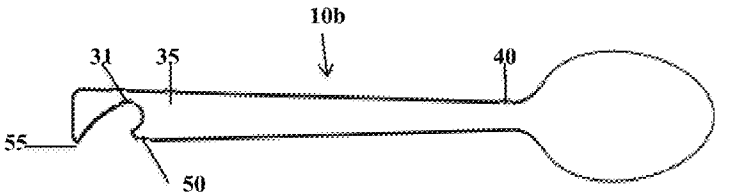
FIG. 18 is a front plan view of the Bottle Cap Removing Spoon of FIG. 15.
Figure 19:
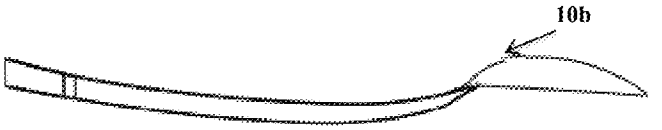
FIG. 19 is a bottom plan view of the Bottle Cap Removing Spoon of FIG. 15.
Figure 16:
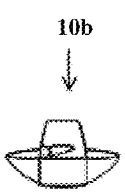
FIG. 16 is a rear plan view of the Bottle Cap Removing Spoon of FIG. 15.
Figure 20:
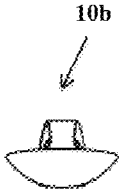
FIG. 20 is a side plan view of the Bottle Cap Removing Spoon of FIG. 15.
Figure 21:
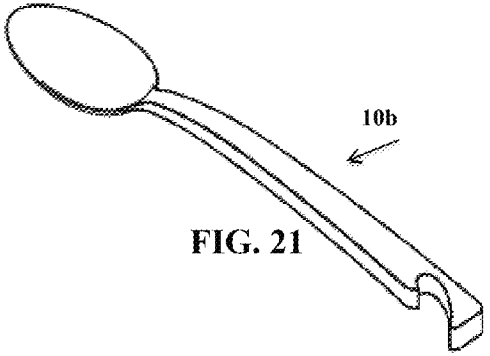
FIG. 21 is a top perspective view of a Bottle Cap Removing Spoon of FIG. 15.

As shown in FIGS. 15-21, a bottle cap removing spoon is generally designated 10*b*. The preferably bottle cap removing spoon 10*b* comprises a main body 20, a cutlery end 25 and a bottle cap removing end 30. The bottle cap removing end 30 preferably comprises a bottle cap opener 31 that preferably comprises an opener cutout 45, a fulcrum portion 50 and a lifting portion 55. The cutlery end 25 preferably comprises a spoon member 26*b*. A center of gravity CG of the bottle cap removing spoon 10*b* preferably lies in the center of the main body 20.

Dashed lines 35 and 40 illustrate a boundary between the main body 20 and the cutlery end 25 and the bottle cap removing end 30. Preferably the main body 20 ranges from 30% to 80% of the length of the bottle cap removing spoon 10*b*, more preferably from 40% to 70% of the length of the bottle cap removing spoon 10*b*, and most preferably from 50% to 60% of the length of the bottle cap removing spoon 10*b*. Preferably the bottle cap removing end 30 ranges from 5% to 33% of the length of the bottle cap removing spoon 10*b*, more preferably from 10% to 25% of the length of the bottle cap removing spoon 10*b*, and most preferably from 15% to 20% of the length of the bottle cap removing spoon 10*b*. Preferably the cutlery end 25 ranges from 5% to 33% of the length of the bottle cap removing spoon 10*b*, more preferably from 10% to 25% of the length of the bottle cap removing spoon 10*b*, and most preferably from 15% to 20% of the length of the bottle cap removing spoon 10*b*.

Preferably, the bottle cap opener 31 is substantially parallel to a plane of the spoon member 26*b*.

A user preferably grasps the bottle cap removing spoon 10*b* within the main body 20.

The bottle cap removing cutlery 10 is preferably composed of a material selected from stainless steel, silver, gold-plating, brass, tin, plastic and aluminum. Most preferably, the bottle cap removing cutlery is composed of stainless steel. Most preferably the bottle cap removing cutlery 10 is die cast 18:10 stainless steel. Alternatively, the bottle cap removing cutlery 10 is formed using three-dimensional printing, using for example direct metal laser sintering.

The bottle cap removing cutlery 10 preferably has a length ranging from 5 inches to 12 inches, more preferably from 6 inches to 10 inches. The bottle cap removing end 30 preferably has a length ranging from 0.5 inch to 2 inches, and is most preferably 1 inch in length.

Preferably there is a distance ranging from 0.05 inch to 0.75 inch between the fulcrum portion 50 and the lifting portion 55. The edges of the fulcrum portion 50 and the lifting portion 55 are preferably dull (non-sharp) to prevent injury to a user when the user is using the bottle cap removing cutlery 10 for a cutlery function.

The bottle cap removing end 30 is preferably the thickest portion of the bottle cap removing cutlery 10. In one preferred example, the bottle cap removing end 30 has a thickness of ¼ inch while the thinnest portion of the cutlery end 25 has a thickness of 1/32 inch, while the main body 20 has a thickness less than the bottle cap removing end 30.

Preferably, the thinnest width of the bottle cap opener 31 should be able to withstand at least 22,000 pounds per square inch load when a user removes a cap from a bottle. The thinnest width is preferably between 1/16 inch and ⅛ inch in thickness.

In use to open a bottle cap, the lifting edge 55 of the bottle cap removing end 30 is positioned on the lower edge of the bottle cap. When an upward force is applied to the main body 20 of the bottle cap removing cutlery 10, the lifting edge 55 exerts an upward force on the bottle cap. The fulcrum portion 50 makes contact with the upper surface of the bottle cap and acts as a fulcrum point for pivoting of the bottle cap removing cutlery 10 to remove the bottle cap from the bottle. The opener cutout 45 is preferably sized to accommodate an intended bottle cap to be removed from a bottle.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention the following:

1. A bottle cap removing cutlery set comprising:

a plurality of bottle cap removing knifes, each of plurality of bottle cap removing knifes comprising main body, a cutlery end comprising a knife member, and a bottle cap removing end comprising a bottle cap opener, wherein the bottle cap opener comprises a fulcrum portion, a lifting portion and an opener cutout, wherein a sharp surface of the knife member is substantially perpendicular relative to the fulcrum portion of the bottle cap opener, wherein the bottle cap removing end is thicker than the main body, and the main body is thicker than the cutlery end;

a plurality of bottle cap removing spoons, each of plurality of bottle cap removing spoons comprising a main body, a cutlery end comprising a spoon member, and a bottle cap removing end comprising a bottle cap opener, wherein the bottle cap opener comprises a fulcrum portion, a lifting portion and an opener cutout, wherein the spoon member is substantially parallel relative to the fulcrum portion of the bottle cap opener, wherein the bottle cap removing end is thicker than the main body, and the main body is thicker than the cutlery end;

a plurality of bottle cap removing forks, each of plurality of bottle cap removing forks comprising a main body, a cutlery end comprising a fork member, and a bottle cap removing end comprising a bottle cap opener, wherein the bottle cap opener comprises a fulcrum portion, a lifting portion and an opener cutout, wherein a plurality of prongs of the fork member is substantially parallel relative to the fulcrum portion of the bottle cap opener, wherein the bottle cap removing end is thicker than the main body, and the main body is thicker than the cutlery end, wherein each of plurality of bottle cap removing forks, each of plurality of bottle cap removing spoons and each of plurality of bottle cap removing knifes has a center of gravity positioned approximately at the center of the main body and wherein the cutlery end is positioned at an opposite end of the main body from the bottle cap opening end.

2. The bottle cap removing cutlery set according to claim 1 wherein each of plurality of bottle cap removing forks, each of plurality of bottle cap removing spoons and each of plurality of bottle cap removing knifes is composed of a material selected from stainless steel, silver, gold-plating, brass, tin, plastic and aluminum.

3. The bottle cap removing cutlery set according to claim 1 wherein the main body for each of plurality of bottle cap removing forks, each of plurality of bottle cap removing spoons and each of plurality of bottle cap removing knifes ranges from 30% to 80% of the length of the bottle cap removing cutlery, the corresponding bottle cap removing end ranges from 5% to 33% of the length of the bottle cap removing cutlery, and the corresponding cutlery end ranges from 5% to 33% of the length of the bottle cap removing cutlery.

4. The bottle cap removing cutlery set according to claim 1 wherein each of plurality of bottle cap removing forks, each of plurality of bottle cap removing spoons and each of plurality of bottle cap removing knifes has a length ranging from 5 inches to 12 inches.

* * * * *